US011415391B2

(12) United States Patent
Lottes et al.

(10) Patent No.: US 11,415,391 B2
(45) **Date of Patent: *Aug. 16, 2022**

(54) DEVICE FOR ADJUSTING A RETICLE

(71) Applicant: STEINER-OPTIK GMBH, Bayreuth (DE)

(72) Inventors: Gerd Lottes, Pegnitz (DE); Werner Mayr-Went, Emtmannsberg (DE)

(73) Assignee: STEINER-OPTIK GMBH

( * ) Notice: Subject to any disclaimer, the term of this patent is extended or adjusted under 35 U.S.C. 154(b) by 0 days.

This patent is subject to a terminal disclaimer.

(21) Appl. No.: 17/228,567

(22) Filed: Apr. 12, 2021

(65) Prior Publication Data

US 2021/0239428 A1 Aug. 5, 2021

Related U.S. Application Data

(63) Continuation of application No. 16/487,052, filed as application No. PCT/EP2018/057358 on Mar. 22, 2018, now Pat. No. 10,976,134.

(30) Foreign Application Priority Data

Apr. 28, 2017 (DE) ..... 10 2017 109 231.5

(51) Int. Cl.
*F41G 1/38* (2006.01)

(52) U.S. Cl.
CPC ..... *F41G 1/38* (2013.01)

(58) Field of Classification Search
CPC ..... F41G 1/16; F41G 1/18; F41G 1/20; F41G 1/22; F41G 1/28; F41G 1/38; G05G 5/03;
(Continued)

(56) References Cited

U.S. PATENT DOCUMENTS 10,976,134 B2 * 4/2021 Lottes ..... F41G 1/38
2009/0044660 A1 2/2009 Bonis
(Continued)

FOREIGN PATENT DOCUMENTS

DE 102007050435 A1 4/2008
DE 102010060343 A1 5/2011
(Continued)

OTHER PUBLICATIONS

Spring Steel, Wikipedia Page, dated by Wayback Machine to Oct. 11, 2016, url: <https://web.archive.org/web/20161011232955/https://en.wikipedia.org/wiki/Spring_steel>.

*Primary Examiner* — Richard W Ridley
*Assistant Examiner* — Brian J McGovern
(74) *Attorney, Agent, or Firm* — Rimon P.C.

(57) ABSTRACT

An apparatus for adjusting a reticle, comprising: an adjustable reticle, a reticle adjustment device comprising an adjustment actuation element movably mounted, a combined click and lock device which comprises a first click device element equipped at least in sections with a click surface formed by a three-dimensional surface or surface structuring, and a second click device element mounted to be movable relative to said first click device element and engages with the click surface of the first click device element, wherein the combined click and lock device is designed to, in a first operating mode, generate acoustic and/or haptic feedback perceptible to an operator, in the case of movement of the adjustment actuation element in at least one adjustment-movement degree of freedom, and is designed to, in a second operating mode, lock movements of the adjustment actuation element in the at least one adjustment-movement degree of freedom.

13 Claims, 3 Drawing Sheets

(58) Field of Classification Search
CPC ..... G05G 5/04; G05G 5/005; G05G 5/02; G05G 5/06; G05G 5/065; G05G 1/08; G05G 1/10; H01H 9/20
See application file for complete search history.

(56) References Cited

U.S. PATENT DOCUMENTS

| | | | | |
|---|---|---|---|---|
| 2009/0205461 | A1 | 8/2009 | Windauer | |
| 2011/0100152 | A1 | 5/2011 | Huynh | |
| 2013/0167425 | A1 | 7/2013 | Crispin | |
| 2013/0312310 | A1 | 11/2013 | Geller | |
| 2014/0196351 | A1* | 7/2014 | Campean ..... | F41G 1/38 42/119 |

FOREIGN PATENT DOCUMENTS

| | | | |
|---|---|---|---|
| DE | 212013000042 | U1 | 8/2014 |
| DE | 102016100219 | A1 | 7/2017 |
| EP | 2314978 | A2 | 4/2011 |

* cited by examiner

DEVICE FOR ADJUSTING A RETICLE

CROSS-REFERENCE TO RELATED APPLICATIONS

This application is a continuation of U.S. application Ser. No. 16/487,052 filed Aug. 19, 2019, granted as U.S. Pat. No. 10,976,134; which is a U.S. national stage entry of an International Application serial no. PCT/EP2018/057358 filed Mar. 22, 2018 which claims priority to German Patent Application serial no. 10 2017 109 231.5 filed Apr. 28, 2017. The contents of these applications are incorporated herein by reference in their entirety as if set forth verbatim.

DESCRIPTION

The invention relates to an apparatus for adjusting a reticle, comprising an adjustable reticle, a reticle adjustment device which comprises an adjustment actuation element which is mounted so as to be movable in an adjustment-movement degree of freedom and which can be actuated, or is provided for actuation, by an operator for the purposes of adjusting the reticle.

Such apparatuses for adjusting a reticle are basically known. Corresponding apparatuses are typically constituent parts of long-range optical devices, for example in the form of telescopic sight devices which can be or are mounted on a firearm. The reticle of corresponding apparatuses is adjustable in terms of position by means of a reticle adjustment device and can thereby be adjusted to a given firing situation, that is to say in particular to a given target range, and to an associated actual point of impact.

Here, it is also known for corresponding apparatuses to be equipped with a locking device, which is designed for locking a movement of the adjustment actuation element in order to lock the reticle, which has been moved into a particular position, so as to prevent it from performing further movements, and with a click device which is separate from said lock device and which is designed to generate acoustic and/or haptic feedback, which is acoustically and/or haptically perceptible to an operator, in the case of movement of the adjustment actuation element.

Corresponding apparatuses have hitherto been of relatively complex construction in particular owing to the structural separation of the lock and click functionality, such that a demand exists for an apparatus for adjusting a reticle which is of relatively simple construction from both a functional and a structural aspect and which is nevertheless equipped with reliable lock and click functionality.

The invention is thus based on the object of specifying a device for adjusting a reticle with a relatively simple construction from a functional and a structural aspect and with reliable lock and click functionality.

The object is achieved by means of an apparatus for adjusting a reticle as per claim 1. The claims dependent thereon relate to advantageous embodiments of the apparatus.

The apparatus described herein ("apparatus") is designed for adjusting the position of a reticle, that is to say a target marking, or, in short, for adjusting a reticle, relative to an initial or reference position. The apparatus may be in the form of an adjustment turret of an adjustment turret device of a long-range optical device, or may form a constituent part of an adjustment turret of a corresponding adjustment turret device.

The apparatus comprises a reticle which is adjustable in terms of its position and a reticle adjustment device which is assigned to the reticle. The reticle adjustment device is designed for adjusting the reticle. The reticle is typically adjustable, by means of the reticle adjustment device, in a linear, in particular horizontal or vertical, movement axis (adjustment axis). Typically, the reticle adjustment device is formed as, or comprises, an adjustment mechanism. The adjustment mechanism is typically designed for converting a rotary movement (rotational movement) into a linear movement which adjusts the reticle in a linear movement axis (adjustment axis).

The reticle adjustment device typically comprises two constituent parts which interact for the purposes of adjusting the reticle. A first constituent part of the reticle adjustment device typically forms a linearly movably mounted adjustment element. The adjustment element may comprise a shank-like adjustment section which is movable against the reticle. An adjustment of the reticle can thus be performed by means of a movement of the adjustment section against the reticle, which movement possibly takes place counter to a restoring force generated by a suitable restoring element, that is to say for example a spring element. A second constituent part of the reticle adjustment device typically forms a rotatably mounted transmission element. The transmission element is coupled to the adjustment element such that rotational movements of the transmission element can be or are converted into linear movements of the adjustment element, in particular against the reticle. The coupling between the transmission element and the adjustment element may be realized by mechanical interaction, that is to say typically an engagement, of thread elements on the transmission element and counterpart thread elements on the adjustment element. The thread elements on the transmission element are typically internal thread sections formed in particular in the region of the inner circumference of a hollow cylindrical transmission element section. The counterpart thread elements on the adjustment element are typically external thread sections formed in particular in the region of the outer circumference of a shank-like adjustment element section.

The reticle adjustment device furthermore comprises an adjustment actuation element which is mounted so as to be movable in an adjustment-movement degree of freedom and which is provided for actuation by an operator for the purposes of adjusting the reticle. The adjustment actuation element is typically coupled rotationally conjointly to the abovementioned transmission element. The adjustment movement degree of freedom may be a rotational-movement degree of freedom, and corresponding actuations by the operator are accordingly rotational movements. The axis of rotation typically corresponds to the central axis of the apparatus defined by the rotationally symmetrical components of the apparatus. The adjustment actuation element may be of rotationally symmetrical form; the adjustment actuation element may for example have a ring-like or ring-shaped or a sleeve-like or sleeve-shaped or a hollow-cylinder-like or hollow cylindrical basic shape. The adjustment actuation element may be arranged coaxially with respect to other (rotationally symmetrical) components of the apparatus.

The apparatus furthermore comprises a combined click and lock device ("device"). The device comprises a first and a second click device element. The first click device element is equipped at least in sections, in particular entirely, with a click surface formed by a three-dimensional, that is to say in particular tooth-like or toothed, preferably knurl-like or knurled, surface or surface structuring. The second click device element is mounted so as to be movable relative to the first click device element. The second click device element is at all times in engagement, that is to say in mechanical contact, with the click surface of the first click device element. The second click device element is thus at all times moved against the click surface of the first click device element such that mechanical contact exists between the second click device element and the first click device element at all times. The second click device element typically has an effective area which is equipped with a corresponding three-dimensional, that is to say in particular tooth-like or toothed, preferably knurl-like or knurled, surface or surface structuring and by means of which the actual engagement or mechanical contact between the second click device element and the first click device element is realized.

The first click device element may be formed as, or may comprise, a structural element which is in particular arranged or formed so as to be rotationally and/or positionally fixed and which has an in particular ring-like or ring-shaped inner circumference, which inner circumference is equipped at least in sections with a three-dimensional surface or surface structuring which forms the click surface. The first click device element may for example have a ring-like or ring-shaped basic shape. The first click device element may be coupled rotationally and/or positionally fixedly to a positionally fixed mounting element of the apparatus. The first click device element may be coupled positionally fixedly to the mounting element of the apparatus directly or indirectly, that is to say with the interposition of at least one further structural element which is coupled positionally fixedly to the mounting element of the apparatus. The mounting element is designed for the mounting of the apparatus on a long-range optical device, that is to say in particular on a telescopic sight device, and for this purpose comprises a number of suitable mounting interfaces. Corresponding mounting interfaces may for example be mounting bores which can be extended through by a mounting element, that is to say for example a mounting screw.

The second click device element may be formed as, or may comprise, a structural element which is received in an in particular hollow-cylinder-like receiving section, which is in particular oriented radially with respect to a central axis of the device, of a transmission element of the reticle adjustment device, which transmission element is coupled in terms of movement to the adjustment actuation element. The transmission element typically comprises a hollow cylindrical main section and the receiving section. The main section is formed so as to run axially with respect to the central axis of the apparatus. The receiving section is formed so as to be oriented so as to run radially with respect to the central axis of the apparatus. The receiving section typically projects from the main section in the region of an in particular free end, which faces toward the reticle, of the main section.

The second click device element is typically coupled in terms of movement to the adjustment actuation element. Movements of the adjustment actuation element in an adjustment-movement degree of freedom thus lead to movements, typically in the same direction, of the second click device element.

As will emerge further below, the second click device element may be moved against the click surface of the first click device element under the action of spring force. This may be realized for example by means of a spring element (compression spring element) which is received in a receiving region of the second click device element.

The device can be transferred into a first and into a second operating mode; in other words, the device has a first and a second operating mode. The device is designed to, in the first operating mode, generate acoustic and/or haptic feedback, which is acoustically and/or haptically perceptible to an operator, in the case of actuation or movement of the adjustment actuation element in the at least one adjustment-movement degree of freedom. Accordingly, the first click device element and the second click device element interact in the first operating mode such that acoustic and/or haptic feedback can be or is generated in the case of a movement of the second click device element relative to the first click device element, that is to say in particular relative to the click surface of the first click device element, which movement is effected in particular by a movement of the adjustment actuation element. Thus, in the first operating mode, the functionality of the device consists in generating acoustic and/or haptic feedback, that is to say a click, in the case of actuation or movement of the adjustment actuation element for the purposes of adjusting the reticle.

The device is designed to, in the second operating mode, lock movements of the adjustment actuation element in the at least one adjustment-movement degree of freedom. The first click device element and the second click device element interact in the second operating mode such that a force which counteracts a movement of the adjustment actuation element in the at least one adjustment-movement degree of freedom can be or is generated in order to lock or impede movements of the adjustment actuation element in the at least one adjustment-movement degree of freedom. In the second operating mode, the second click device element is typically clamped or braced against the first click device element such that a force which counteracts a movement of the adjustment actuation element in the at least one adjustment-movement degree of freedom can be or is generated in order to lock or (considerably) impede movements of the adjustment actuation element in the at least one adjustment-movement degree of freedom. The second click device element is moved against the click surface of the first click device element with a (considerably) greater force in the second operating mode than in the first operating mode. Thus, in the second operating mode, the functionality of the device consists in locking or (considerably) impeding a (further) actuation or movement of the reticle through generation of a force which counteracts an actuation or movement of the adjustment actuation element.

Locking is typically not to be understood to mean complete locking of a (further) actuation or movement of the adjustment actuation element in such a way as to prevent a (further) actuation of the adjustment actuation element without damage to or destruction of the reticle adjustment device, though such complete locking is basically conceivable. The device is typically designed to, in the second operating mode, lock actuations or movements of the adjustment actuation element in the at least one adjustment-movement degree of freedom (only) up to a predefinable or predefined maximum force or maximum torque limit value. The device is thus typically designed to, if a force or torque acting on the adjustment actuation element exceeds the maximum force or maximum torque limit value, enable a further actuation or movement of the adjustment actuation element in the at least one adjustment-movement degree of freedom without damage to or destruction of the device. The maximum force or maximum torque limit value is typically selected, through structural design of various structural elements of the apparatus, in particular of the device, that is to say in particular of the click device elements and of a control element which will be discussed in more detail further below, such that said maximum force or maximum torque limit value can be exceeded by a person only, if at all, with a considerable expenditure of force, in particular outside the expenditure of force required during intended use of the apparatus. Forces or torques of at least 400 Ncm typically have to be applied in order, in the second operating mode of the device, to actuate or move the adjustment actuation element further.

In any case, the device has a reliable click and lock functionality; the device thus combines a click functionality and a lock functionality in one and the same component group. A device which is improved in relation to the prior art described in the introduction is provided.

The device may comprise an actuation element which is mounted so as to be movable in at least one actuation-movement degree of freedom independently of the adjustment actuation element and which is provided for actuation by an operator for the purposes of transferring the device into the first and/or second operating mode. The actuation element may be of rotationally symmetrical form; the actuation element may for example have a ring-like or ring-shaped or sleeve-like or sleeve-shaped or a hollow-cylinder-like or hollow cylindrical geometrical basic shape. The actuation element may be arranged coaxially with respect to other (rotationally symmetrical) components of the apparatus. The actuation element may comprise a for example spherical-cap-like or spherical-cap-shaped actuation section which is arranged or formed so as to lie at least in sections on a face or top side of the adjustment actuation element and which is provided for being gripped by an operator for the purposes of actuating the actuation element.

The actuation-movement degree of freedom may be a rotational-movement degree of freedom. The actuation element may thus be mounted so as to be movable between a first rotational (angle) position with respect to a central axis of the apparatus, which first rotational (angle) position correlates with the first operating mode of the device, and a second rotational (angle) position with respect to the central axis of the apparatus, which second rotational (angle) position correlates with the second operating mode of the device. The device can thus be transferred into the first and into the second operating mode by means of rotational movements, induced by actuations by an operator, of the actuation element between a first rotational (angle) position and a second rotational (angle) position.

In an alternative or additional embodiment, the actuation element may be mounted so as to be movable between a first axial position with respect to a central axis of the apparatus, which first axial position correlates with the first operating mode of the device, and a second axial position with respect to the central axis of the apparatus, which second axial position correlates with the second operating mode of the device. The actuation-movement degree of freedom may consequently also be an axial translational-movement degree of freedom. The device can thus be transferred into the first and into the second operating mode by means of axial translational movements, that is to say for example pushing or pulling movements, induced by actuations by an operator, of the actuation element between a first axial position, that is to say for example an upper position, and a second axial position, that is to say for example a lower position.

In a further alternative or additional embodiment, the actuation element may be mounted so as to be movable between a first radial position with respect to a central axis of the apparatus, which first radial position correlates with the first operating mode of the device, and a second radial position with respect to the central axis of the apparatus, which second radial position correlates with the second operating mode of the device. The actuation-movement degree of freedom may consequently also be a radial translational-movement degree of freedom. The device can thus be transferred into the first and into the second operating mode by means of radial movements, that is to say for example sliding movements, induced by actuations by an operator, of the actuation element between a first radial position, that is to say for example an outer position, and a second radial position, that is to say for example an inner position.

From the above statements, it emerges that combined movements of the actuation element in multiple different actuation-movement degrees of freedom are also conceivable for the purposes of transferring the device into the first or second operating mode.

The apparatus or the device may comprise a control element which is in particular of hollow-cylinder-like or hollow cylindrical form at least in sections and which comprises a control section which can be or is coupled to the second click device element. The control element is typically coupled in terms of movement to the actuation element. Movements of the actuation element in an actuation-movement degree of freedom thus lead to movements, typically in the same direction, of the control element. The control element may be of rotationally symmetrical form; the control element may have a hollow-cylinder-like or hollow cylindrical geometrical basic shape. The control element may be arranged coaxially with respect to other (rotationally symmetrical) components of the apparatus. The control element typically comprises a main section. The main section is typically formed so as to be oriented so as to run axially with respect to the central axis of the apparatus. The control section may in particular be arranged or formed in the region of an in particular free end, which faces toward the reticle, of the main section of the control element.

The control section may comprise a first control section region of small wall thickness and a second control section region of relatively large wall thickness. The transition between the first and second control section regions may be continuous. The transition between the first and second control section regions may be realized for example by means of a control section region running in ramped fashion between said first and second control section regions. Respective control section regions extend, as viewed in a circumferential direction, in each case over a certain region of the outer circumference of the main section of the control element.

The first control section region typically acts, in the first operating mode of the device, on the second click device element, whereby the second click device element is moved against the click surface of the first click device element such that acoustic and/or haptic feedback can be or is generated in the case of a movement of the second click device element relative to the click surface of the first click device element, which movement is effected in particular by a movement of the adjustment actuation element. The action of the first control section region on the second click device element may for example be realized in that, in the first operating mode, the first control section region bears against the second click device element or against a structural element coupled thereto. Thus, in the first operating mode, the first control section region can be moved relative to the second click device element such that said first control section region bears against the second click device element or against a structural element coupled to said second click device element. A structural element coupled to the second click device element may for example be a peg element which is received in sections in a receiving space of the second click device element. Between the peg element and the second click device element there may be positioned a spring element by means of which the second click device element is moved against the click surface of the first click device element under the action of spring force. The spring element may be supported at one side on the peg element and at the other side on the second click device element.

The second control section region typically acts, in the second operating mode of the device, on the second click device element, whereby the second click device element is moved with clamping or bracing action against the click surface of the first click device element such that a force which counteracts a movement of the adjustment actuation element in the at least one adjustment-movement degree of freedom can be or is generated in order to lock movements of the adjustment actuation element in the at least one adjustment-movement degree of freedom. The action of the second control section region on the second click device element may be realized for example in that, in the second operating mode, the second control section region bears against the second click device element or against a structural element coupled thereto, that is to say for example the abovementioned peg element. Thus, in the second operating mode, the second control section region can be moved relative to the second click device element such that said second control section region bears against the second click device element or against a structural element coupled to said second click device element. Owing to the relatively large wall thickness of the second control section region in relation to the first control section region, the second click device element is moved with clamping or bracing action against the click surface of the first click device element, that is to say is clamped or braced against the click surface of the first click device element, whereby the generation of the force which counteracts a movement of the adjustment actuation element in the at least one adjustment-movement degree of freedom in order to lock movements of the adjustment actuation element in the at least one adjustment-movement degree of freedom is possible. As mentioned, in the second operating mode, the second click device element is moved against the click surface of the first click device element with a (considerably) greater force, which results in the clamping or bracing action.

The control element may be of elastically resilient or reversibly deformable form at least in the region of the control section. An elastically resilient or reversibly deformable form of the control element or section is to be understood to mean an elastically resilient behaviour of the control element or section, that is to say in particular an elastic restoring behaviour after a deflection of the control element or section from a basic state into a deflected state, which may be realized by means of geometrical structural measures and/or by means of an elastically resilient material, in particular metal, preferably steel. The elastically resilient form of the control element or section permits, in the second operating mode, said enablement of a further actuation or movement of the adjustment actuation element in the at least one adjustment-movement degree of freedom without damage to or destruction of the device in the case of an acting force or torque exceeding the maximum force or maximum torque limit value.

The invention relates not only to the apparatus but also to a long-range optical device. The long-range optical device is for example a telescopic sight device which can be mounted, or is provided for being mounted, on a firearm or gun, for example a rifle. The telescopic sight device serves in particular for optical magnification of remote objects viewed through it. For this purpose, the long-range optical device comprises multiple optical, that is to say in particular optically magnifying, elements arranged between an objective and an eyepiece. The optical elements, which may for example be lenses or prisms, form an optical channel.

The long-range optical device comprises at least one apparatus as described for adjusting a reticle. All statements relating to the apparatus apply analogously to the long-range optical device. The reticle is arranged in the optical channel, formed by the optical elements, of the long-range optical device. The reticle is adjustable in terms of its position (within the optical channel) and can thus be adjusted to a given firing situation, that is to say in particular to a given target range, and to an associated actual point of impact. A position adjustment of the reticle is to be understood in particular to mean an adjustment of the horizontal and/or vertical position of the reticle, in particular in relation to a horizontal and/or vertical initial or reference position.

BRIEF DESCRIPTION OF THE DRAWINGS

The invention will be discussed in more detail on the basis of exemplary embodiments in the figures of the drawing, in which:

FIGS. 1 and 2 each show a longitudinally sectioned illustration of an apparatus 1 for adjusting a reticle 2 according to an exemplary embodiment. FIG. 3 shows an enlarged and slightly tilted illustration of the detail III shown in FIG. 1. From the figures, it can be seen that the apparatus 1 may be an adjustment turret of an adjustment turret device.

Figure 1:
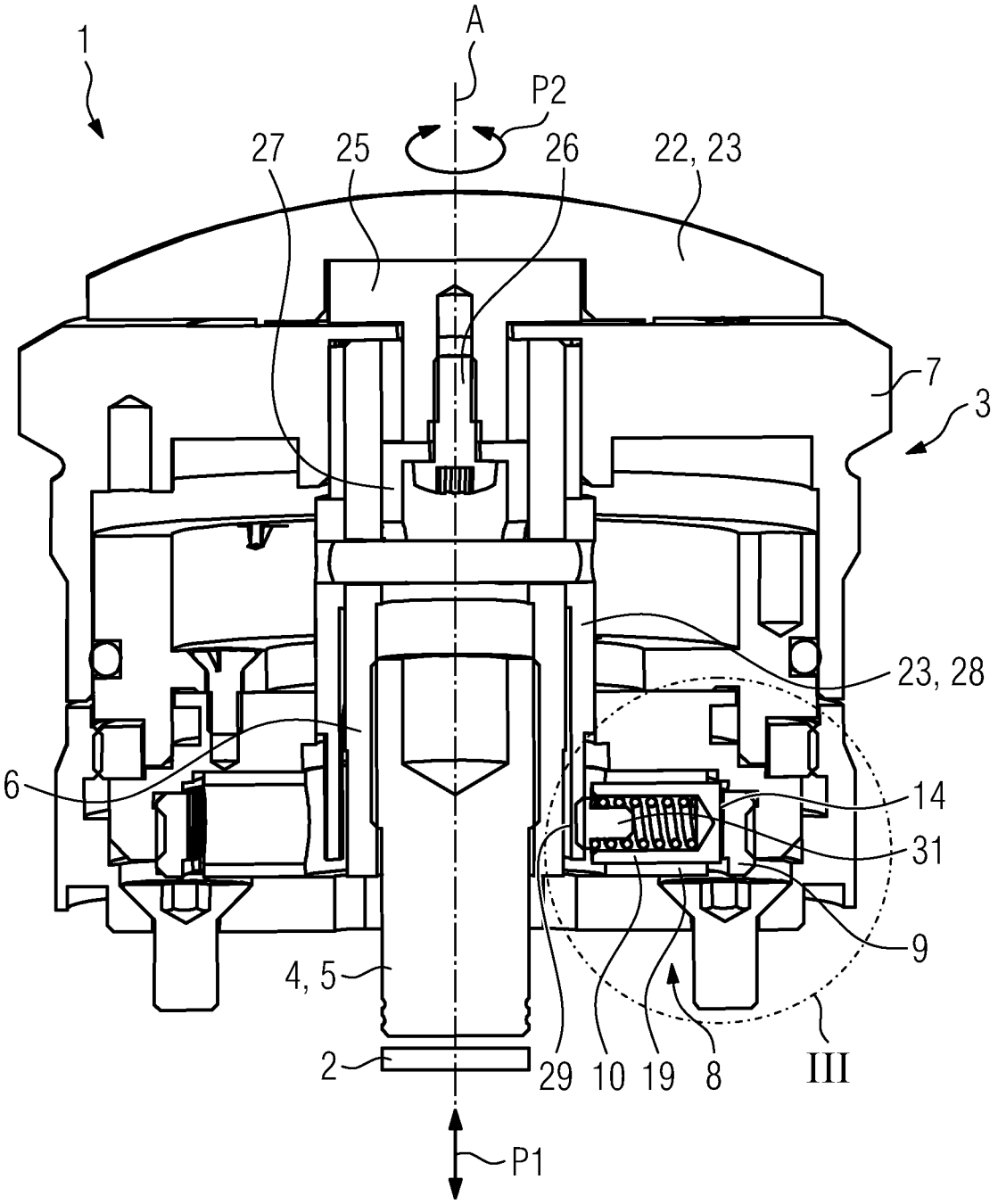
FIGS. 1 and 2 each show a longitudinally sectioned illustration of an apparatus for adjusting a reticle according to an exemplary embodiment.

The apparatus 1 comprises a reticle 2, that is to say a target marking, which is indicated purely schematically in the figures and which is adjustable in terms of its position (relative to an initial or reference position). The reticle 2 is, in the assembled state of the apparatus 1 with a long-range optical device (not shown), that is to say for example a telescopic sight device, arranged in an optical channel formed by the optical elements of the long-range optical device. The reticle 2 is adjustable in terms of its position (within the optical channel) and can thus be adjusted to a given firing situation, that is to say in particular to a given target range, and to an associated actual point of impact.

The apparatus 1 comprises a reticle adjustment device 3 which is assigned to the reticle 2. The reticle adjustment device 3 is designed for adjusting the reticle 2. The reticle 2 is, by means of the reticle adjustment device 3, adjustable in a linear movement axis (adjustment axis) indicated by the double arrow P1 shown in FIGS. 1 and 2. The reticle adjustment device 3 is in the form of an adjustment mechanism which is designed for converting a rotary movement into a linear movement which adjusts the reticle 2 in the linear movement axis (adjustment axis). As can be seen, the linear movement axis coincides with the central axis A defined by the rotationally symmetrical components (not described in any more detail below) of the apparatus 1.

The reticle adjustment device 3 comprises two constituent parts which interact for the purposes of adjusting the reticle 2. A first constituent part of the reticle adjustment device 3 is a linearly movably mounted adjustment element 4 which is coupled in terms of movement to the reticle 2. The adjustment element 4 comprises a shank-like adjustment section 5 which can be moved against the reticle 2. An adjustment of the reticle 2 is realized by means of a movement of the adjustment section 5 against the reticle 2 which takes place possibly counter to a restoring force generated by a suitable restoring element (not shown), that is to say for example a spring element. A second constituent part of the adjustment device 3 is formed by a rotatably mounted transmission element 6. The transmission element 6 is coupled to the adjustment element 4 such that rotational movements of the transmission element 6 can be or are converted into linear movements of the adjustment element 4, in particular against the reticle 2. The coupling between the transmission element 6 and the adjustment element 4 is realized by means of mechanical interaction of thread elements (not designated) on the transmission element and counterpart thread elements (not designated) on the adjustment element. The thread elements on the transmission element are internal thread sections formed in the region of the inner circumference of a hollow cylindrical transmission element section. The counterpart thread elements on the adjustment element are external thread sections formed in the region of the outer circumference of the shank-like adjustment section 5.

The reticle adjustment device 3 furthermore comprises an adjustment actuation element 7 which is mounted so as to be movable in an adjustment-movement degree of freedom and which is provided for being actuated by an operator for the purposes of adjusting the reticle 2. The adjustment actuation element 7 is coupled rotationally conjointly to the transmission element 6. The adjustment-movement degree of freedom is a rotational-movement degree of freedom indicated in FIG. 1 by the double arrow P2, and corresponding actuations by the operator are accordingly rotational movements. The axis of rotation corresponds to the central axis A of the apparatus 1. In the exemplary embodiment, the adjustment actuation element 7 has a rotationally symmetrical, that is to say ring-like or ring-shaped, geometrical basic shape and is arranged coaxially with respect to other components of the apparatus 1.

The apparatus 1 furthermore comprises a combined click and lock device 8 ("device"). The device 8 comprises a first and a second click device element 9, 10. The first click device element 9 is equipped, as can be seen in particular from FIG. 3, with a click surface 12 formed by a three-dimensional, that is to say tooth-like or toothed or knurl-like or knurled surface 11 or surface structuring 11'. The second click device element 10 is mounted so as to be movable relative to the first click device element 9. The second click device element 10 engages, that is to say is in mechanical contact, with the click surface 12 of the first click device element 9. The second click device element 10 is thus moved against the click surface 12 of the first click device element 9 such that mechanical contact exists between the second click device element 10 and the first click device element 9 at all times. In turn, as can be seen in particular from FIG. 3, the second click device element 10 has an effective surface 14 which is equipped with a corresponding three-dimensional surface structuring 13, by means of which the actual engagement or mechanical contact between the second click device element 10 and the first click device element 9 is generated.

The first click device element 9 is formed as a rotationally or positionally fixedly arranged ring-like structural element with an inner circumference equipped with the three-dimensional surface 11 or surface structuring 11' which forms the click surface 12. The first click element device 9 is coupled rotationally or positionally fixedly to a rotationally or positionally fixed mounting element 15 of the apparatus 1. In the exemplary embodiment shown in the figures, the first click device element 9 is coupled rotationally or positionally fixedly to the mounting element 15 indirectly, that is to say with the interposition of a further structural element 16 which is coupled rotationally or positionally fixedly to the mounting element 15. A direct coupling of the first click device element 9 to the mounting element 15 would self-evidently also be conceivable. The mounting element 15, also referred to as mounting base, is designed for the mounting of the apparatus 1 on a long-range optical device, and for this purpose comprises a number of suitable mounting interfaces 17. Corresponding mounting interfaces are, in the exemplary embodiment, mounting bores which can be extended through by a mounting element 18, that is to say for example a mounting screw.

The second click device element 10 is formed as a structural element 20 which is received in a hollow cylindrical receiving section 19, which is oriented so as to run radially with respect to a central axis A of the apparatus 1, of the transmission element 6 of the reticle adjustment device 3. The transmission element 6 comprises a hollow cylindrical main section 21 which is formed so as to be oriented so as to run axially with respect to the central axis A of the apparatus 1, and the receiving section 19, which is formed so as to be oriented so as to run radially with respect to the central axis A of the apparatus 1. The receiving section projects from the main section 20 in the region of an end, which faces toward the reticle 2, of the main section 20.

The second click device element 10 is in this way coupled in terms of movement to the adjustment actuation element 7. Movements of the adjustment actuation element 7 thus lead to movements, in the same direction, of the second click device element 10.

The device 8 can be transferred into a first and into a second operating mode. The device 8 is designed to, in the first operating mode shown in FIGS. 1 and 3, generate acoustic and/or haptic feedback, which is acoustically and/or haptically perceptible to an operator, in the case of actuation or movement of the adjustment actuation element 7. The first click device element 9 and the second click device element 10 interact in the first operating mode such that acoustic and/or haptic feedback can be or is generated in the case of a movement of the second click device element 10 relative to the first click device element 9 or relative to the click surface 12 of the first click device element 9, which movement is effected by a movement of the adjustment actuation element 7. Thus, in the first operating mode, the functionality of the device 8 consists in generating acoustic and/or haptic feedback, that is to say a click, in the case of actuation or movement of the adjustment actuation element 7 for the purposes of adjusting the reticle 2.

Figure 2:
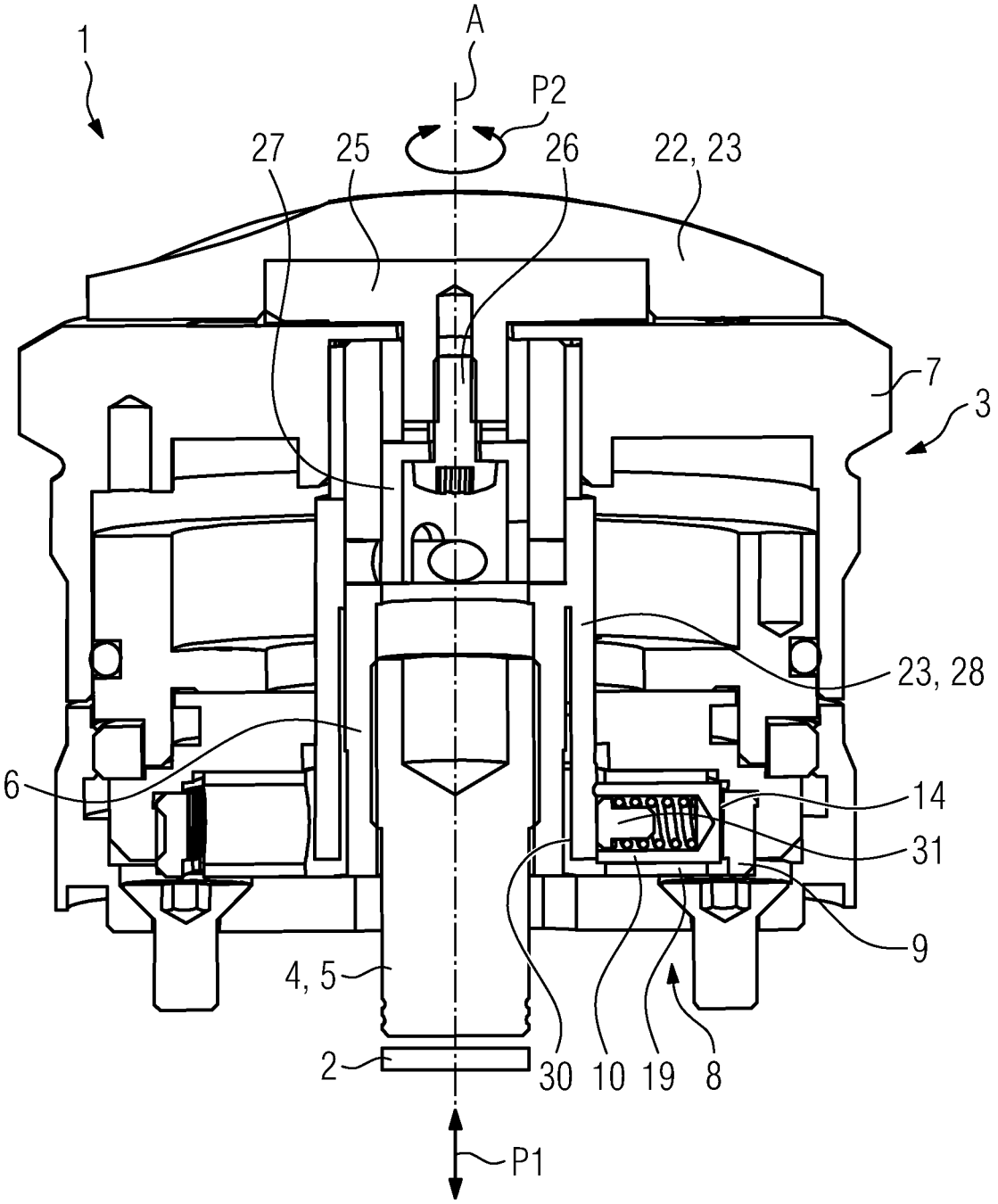

The device 8 is designed to, in the second operating mode shown in FIG. 2, lock movements of the adjustment actuation element 7. The first click device element 9 and the second click device element 10 interact in the second operating mode such that a force which counteracts a movement of the adjustment actuation element 7 can be or is generated in order to lock or impede movements of the adjustment actuation element 7. In the second operating mode, the second click device element 10 is clamped or braced against the first click device element 9 such that a force which counteracts a movement of the adjustment actuation element 7 can be or is generated in order to lock or (considerably) impede movements of the adjustment actuation element 7. The second click device element 10 is moved against the click surface 12 of the first click device element 9 with a (considerably) greater force in the second operating mode in comparison to the first operating mode, which results in the clamping or bracing action. Thus, in the second operating mode, the functionality of the device 8 consists in locking or (considerably) impeding a (further) actuation or movement of the reticle 2 through generation of a force which counteracts an actuation or movement of the adjustment actuation element 7.

Locking is typically not to be understood to mean complete locking of a (further) actuation or movement of the adjustment actuation element 7 in such a way as to prevent a (further) actuation of the adjustment actuation element 7 without damage to or destruction of the reticle adjustment device 3. The device 8 is designed to, in the second operating mode, lock actuations or movements of the adjustment actuation element 7 (only) up to a predefinable or predefined maximum force or maximum torque limit value. The device 8 is thus designed to, if a force or torque acting on the adjustment actuation element 7 exceeds the maximum force or maximum torque limit value, enable a further actuation or movement of the adjustment actuation element 7 without damage to or destruction of the device 8. The maximum force or maximum torque limit value is selected, in particular through structural design of various structural elements of the apparatus 1 or of the device 8, that is to say in particular of the click device elements 9, 10 and of a control element 22 which will be discussed in more detail further below, such that said maximum force or maximum torque limit value can be exceeded by a person only, if at all, with a considerable expenditure of force, in particular outside the expenditure of force required during intended use of the apparatus 1.

The device 8 comprises an actuation element 22 which is mounted so as to be movable in at least one actuation-movement degree of freedom independently of the adjustment actuation element 7 and which is provided for actuation by an operator for the purposes of transferring the device 8 into the first and/or into the second operating mode. In the exemplary embodiment, the actuation element 22 is arranged coaxially with respect to other (rotationally symmetrical) components of the apparatus 1 and comprises actuation section 23 which is arranged so as to lie on a face or top side of the adjustment actuation element 7 and which is provided for being gripped by an operator for the purposes of actuating the actuation element 22.

The actuation-movement degree of freedom of the actuation element 22 is, in the exemplary embodiment, a rotational-movement degree of freedom; the actuation element 22 is thus mounted so as to be rotatable about the axis of rotation formed by the central axis A of the apparatus 1. The actuation element 22 is thus mounted so as to be movable between a first rotational (angle) position with respect to the central axis A of the apparatus, which first rotational (angle) position correlates with the first operating mode of the device 8, and a second rotational (angle) position with respect to the central axis A of the apparatus 1, which second rotational (angle) position correlates with the second operating mode of the device 8. The device 8 can thus be transferred into the first and into the second operating mode by means of rotational movements, induced by actuations by an operator, of the actuation element 22 between a first rotational (angle) position and a second rotational (angle) position.

In an alternative exemplary embodiment, it would be possible for the actuation element 22 to alternatively or additionally be mounted so as to be movable between a first axial and/or radial position with respect to the central axis A of the apparatus 1, which first axial and/or radial position correlates with the first operating mode of the device 8, and a second axial and/or radial position with respect to the central axis A of the apparatus 1, which second axial and/or radial position correlates with the second operating mode of the device 8.

The apparatus 1 or the device 8 comprises a control element 23 which is of hollow-cylinder-like form at least in sections and which comprises a control section 24 which can be or is coupled to the second click device element 10. The control element 23 is coupled in terms of movement to the actuation element 22 by means of the structural elements 25, 26; structural element 25 is a connecting element which is coupled rotationally conjointly to the actuation element 22, and structural element 26 is a fastening element which couples the connecting element rotationally conjointly to a connecting region 27 of the control element 23, which connecting region extends from a main section 28 of the control element 23. Movements of the actuation element 22 in an actuation-movement degree of freedom thus lead to movements, in the same direction, of the control element 23.

The control element 23 comprises a main section 28. The main section 28 is formed so as to be oriented so as to run axially with respect to the central axis A of the apparatus 1. The control section 24 is arranged in the region of an end, which faces toward the reticle 2, of the main section 28 of the control element 23.

The control section 24 comprises a first control section region 29 (cf. FIGS. 1 and 3) of small wall thickness and a second control section region 30 (cf. FIG. 2) of relatively large wall thickness. The transition between the first and second control section regions 29, 30 may be continuous and realized by means of a control section region (not shown) running in ramped fashion between said first and second control section regions.

Figure 3:
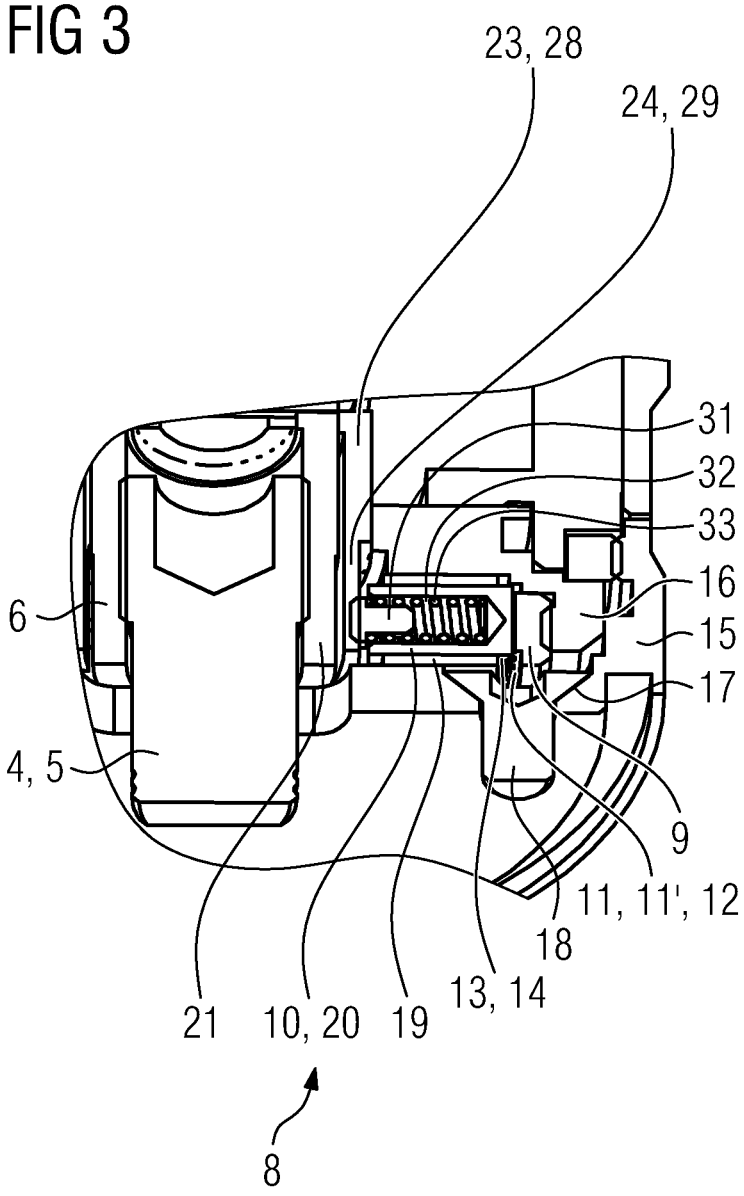
FIG. 3 is an enlarged illustration of the detail Ill shown in FIG. 1.

As can be seen, the first control section region 29 acts, in the first operating mode of the device 8 shown in FIGS. 1 and 3, on the second click device element 10, whereby the second click device element 10 is moved against the click surface 12 of the first click device element 9 such that acoustic and/or haptic feedback can be or is generated in the case of a movement of the second click device element 10 relative to the click surface 12 of the first click device element 9. The action of the first control section region 29 on the second click device element 10 is realized in the exemplary embodiment in that, in the first operating mode, the first control section region 29 bears against a structural element 31 coupled to the second click device element 10. Thus, in the first operating mode, the first control section region 29 is moved relative to the second click device element 10 such that said first control section region bears against the structural element 31 coupled to the second click device element 10. The structural element 31 is a peg element 31 which is received in sections in a receiving space 32 of the second click device element 10. As can be seen, between the peg element 31 and the second click device element 10, there is positioned a spring element 33 by means of which the second click device element 10 is moved against the click surface 12 of the first click device element 9 under the action of spring force. The spring element 33 is supported at one side on the peg element and at the other side on the second click device element 10.

The second control section region 30 acts, in the second operating mode of the device 8, on the second click device element 10, whereby the second click device element 10 is moved with clamping or bracing action against the click surface 12 of the first click device element 9 such that the force which counteracts a movement of the adjustment actuation element 8 can be or is generated in order to lock movements of the adjustment actuation element 7. The action of the second control section region 30 on the second click device element 10 is realized in that, in the second operating mode, the second control section region 30 bears against the structural element 31, that is to say the peg element. Thus, in the second operating mode, the second control section region 30 is moved relative to the second click device element 10 such that said second control section region bears against the structural element 31. Owing to the relatively large wall thickness of the second control section region 30 in relation to the first control section region 29, the second click device element is moved with clamping or bracing action against the click surface 12 of the first click device element 9, that is to say is clamped or braced against the click surface 12 of the first click device element 9, whereby the generation of the force which counteracts a movement of the adjustment actuation element 7 in order to lock movements of the adjustment actuation element 7 is possible.

The control element 23 is of elastically resilient or reversibly deformable form in the region of the control section 28. The elastically resilient form of the control element 23 or section 28 permits, in the second operating mode, said enablement of a further actuation or movement of the adjustment actuation element 7 without damage to or destruction of the device 8 in the case of an acting force or torque exceeding the maximum force or maximum torque limit value.

The invention claimed is:

1. Apparatus for adjusting a reticle, comprising:

an adjustable reticle, a reticle adjustment device which comprises an adjustment actuation element which is mounted so as to be movable in an at least one adjustment-movement degree of freedom and which is provided for actuation by an operator for the purposes of adjusting the reticle, characterized by a combined click and lock device which comprises a first click device element, which is equipped at least in sections with a click surface formed by a three-dimensional toothed surface or surface structuring, and a second click device element, which is mounted so as to be movable relative to said first click device element and which engages with the click surface of the first click device element, wherein the combined click and lock device is designed to, in a first operating mode, generate acoustic and/or haptic feedback, which is acoustically and/or haptically perceptible to the operator, in the case of movement of the adjustment actuation element in the at least one adjustment-movement degree of freedom, and is designed to, in a second operating mode, lock movements of the adjustment actuation element in the at least one adjustment-movement degree of freedom, wherein the combined click and lock device; further comprising an actuation element for actuation by the operator for the purposes of transferring the combined click and lock device into the first and/or second operating mode which is assigned to the combined click and lock device and which is movable in at least one actuation-movement degree of freedom independently of the adjustment actuation element; wherein a control element which is motion coupled to the actuation element comprises a hollow-cylindrical elastically resilient outer wall providing a radial support for a radial inner portion of the second click device element.

2. The apparatus according to claim 1, wherein the first click device element and the second click device element interact in the first operating mode such that acoustic and/or haptic feedback can be or is generated in the case of a movement of the second click device element relative to the first click device element, relative to the click surface of the first click device element, which movement is effected by a movement of the adjustment actuation element.

3. The apparatus according to claim 1, wherein the first click device element and the second click device element interact with clamping or bracing action in the second operating mode such that a force which counteracts the movement of the adjustment actuation element in the at least one adjustment-movement degree of freedom can be or is generated in order to lock movements of the adjustment actuation element in the at least one adjustment-movement degree of freedom.

4. The apparatus according to claim 1, wherein the control element in the region of an end facing toward the reticle comprises the control section which can be or is coupled to the second click device element.

5. The apparatus according to claim 1, wherein the second click device element is coupled in terms of movement to the adjustment actuation element.

6. The apparatus according to claim 1, wherein the second click device element is formed as, or comprises, a structural element which is received in a hollow-cylindrical receiving section, which is oriented radially with respect to a central axis of the device of a transmission element which is coupled in terms of movement to the adjustment actuation element.

7. The apparatus according to claim 1, wherein the second click device element is moved against the click surface of the first click device element under the action of spring force.

8. The apparatus according to claim 1, wherein the first click device element is formed as, or comprises, a structural element which is arranged or formed so as to be rotationally fixed and which has a ring-shaped inner circumference, which inner circumference is equipped at least in sections with the three-dimensional surface or surface structuring which forms the click surface.

9. A long-range optical device comprising at least one apparatus for adjusting a reticle according to claim 1.

10. An apparatus for adjusting a reticle, comprising:

an adjustable reticle, a reticle adjustment device which comprises an adjustment actuation element which is mounted so as to be movable in an at least one adjustment-movement degree of freedom and which is provided for actuation by an operator for the purposes of adjusting the reticle, characterized by a combined click and lock device which comprises a first click device element, which is equipped at least in sections with a click surface formed by a three-dimensional toothed surface or surface structuring, and a second click device element, which is mounted so as to be movable relative to said first click device element and which engages with the click surface of the first click device element, wherein the combined click and lock device is designed to, in a first operating mode, generate acoustic and/or haptic feedback, which is acoustically and/or haptically perceptible to the operator, in the case of movement of the adjustment actuation element in the at least one adjustment-movement degree of freedom, and is designed to, in a second operating mode, lock movements of the adjustment actuation element in the at least one adjustment-movement degree of freedom, wherein the combined click and lock device; further comprising an actuation element for actuation by the operator for the purposes of transferring the combined click and lock device into the first and/or second operating mode which is assigned to the combined click and lock device and which is movable in at least one actuation-movement degree of freedom independently of the adjustment actuation element, wherein a control element which is motion coupled to the actuation element comprises an elastically resilient control section; wherein the control element has at least in sections a hollow-cylindrical shape and comprises an outer wall providing a radial support for the second click device element, wherein the control element in the region of an end facing toward the reticle comprises the control section which can be or is coupled to the second click device element, and wherein the control section comprises a first control section region and a second control section region, the second control section region having a smaller wall thickness than the first control section region.

11. The apparatus according to claim 10, wherein the first control section region acts, in the first operating mode of the combined click and lock device, on the second click device element, bears against the second click device element or against a structural element coupled thereto, whereby the second click device element is moved against the click surface of the first click device element such that acoustic and/or haptic feedback can be or is generated in the case of a movement of the second click device element relative to the click surface of the first click device element, which movement is effected by the movement of the adjustment actuation element.

12. The apparatus according to claim 10, wherein the second control section region acts, in the second operating mode of the combined click and lock device, on the second click device element, bears against the second click device element or against a structural element coupled thereto, whereby the second click device element is moved with clamping or bracing action against the click surface of the first click device element such that a force which counteracts the movement of the adjustment actuation element in the at least one adjustment-movement degree of freedom can be or is generated in order to lock movements of the adjustment actuation element in the at least one adjustment-movement degree of freedom.

13. An apparatus for adjusting a reticle, comprising:

an adjustable reticle, a reticle adjustment device which comprises an adjustment actuation element which is mounted so as to be movable in an at least one adjustment-movement degree of freedom and which is provided for actuation by an operator for the purposes of adjusting the reticle, characterized by a combined click and lock device which comprises a first click device element, which is equipped at least in sections with a click surface formed by a three-dimensional toothed surface or surface structuring, and a second click device element, which is mounted so as to be movable relative to said first click device element and which engages with the click surface of the first click device element, wherein the combined click and lock device is designed to, in a first operating mode, generate acoustic and/or haptic feedback, which is acoustically and/or haptically perceptible to the operator, in the case of movement of the adjustment actuation element in the at least one adjustment-movement degree of freedom, and is designed to, in a second operating mode, lock movements of the adjustment actuation element in the at least one adjustment-movement degree of freedom, wherein the combined click and lock device; further comprises an actuation element for actuation by the operator for the purposes of transferring the combined click and lock device into the first and/or second operating mode which is assigned to the combined click and lock device and which is movable in at least one actuation-movement degree of freedom independently of the adjustment actuation element, wherein a control element which is motion coupled to the actuation element and which comprises an elastically resilient control section; wherein the control element has at least in sections a hollow-cylindrical shape and comprises an outer wall providing a radial support for the second click device element, and wherein the combined click and lock device is designed to, in the second operating mode, lock movements of the adjustment actuation element in the at least one adjustment-movement degree of freedom up to a maximum force or maximum torque limit value, wherein the combined click and lock device is designed to, if a force or torque acting on the adjustment actuation element exceeds the maximum force or maximum torque limit value, enable a further movement of the adjustment actuation element in the at least one adjustment-movement degree of freedom without damage to or destruction of the combined click and lock device.

* * * * *